US008376408B2

(12) United States Patent
Legrand

(10) Patent No.: US 8,376,408 B2
(45) Date of Patent: Feb. 19, 2013

(54) CHILDREN'S BOOK

(76) Inventor: Christian Noel Guy Legrand, Nonthaburi (TH)

( * ) Notice: Subject to any disclaimer, the term of this patent is extended or adjusted under 35 U.S.C. 154(b) by 96 days.

(21) Appl. No.: 13/107,575

(22) Filed: May 13, 2011

(65) Prior Publication Data

US 2012/0153606 A1 Jun. 21, 2012

(30) Foreign Application Priority Data

Dec. 17, 2010 (EP) ..... 10380158

(51) Int. Cl.

| | |
|---|---|
| ***B42D 5/00*** | (2006.01) |
| ***B42D 1/08*** | (2006.01) |
| ***B42D 1/00*** | (2006.01) |
| ***B42F 5/00*** | (2006.01) |
| ***A63H 33/38*** | (2006.01) |

(52) U.S. Cl. ..... 281/40; 281/22; 281/23; 281/38; 446/147; 446/149; 446/151

(58) Field of Classification Search ..... 281/22, 281/23, 38, 40; 446/147, 149, 150
See application file for complete search history.

(56) References Cited

U.S. PATENT DOCUMENTS

| | | | | |
|---|---|---|---|---|
| 2,548,043 | A * | 4/1951 | Muhlhauser | 281/42 |
| 3,206,887 | A * | 9/1965 | Eyler et al. | 446/93 |
| 3,740,128 | A * | 6/1973 | Adler | 281/40 |
| 3,758,693 | A * | 9/1973 | Ebert | 446/148 |
| 3,918,180 | A | 11/1975 | Chamberlin | |
| 5,868,599 | A * | 2/1999 | Kaufman | 446/148 |
| 6,364,360 | B1 * | 4/2002 | Kaufman | 281/38 |
| 6,712,396 | B2 * | 3/2004 | Derraugh | 281/38 |
| 7,144,044 | B2 * | 12/2006 | Legrand | 281/40 |
| 2009/0206590 | A1 * | 8/2009 | Gerth | 281/40 |

FOREIGN PATENT DOCUMENTS

| | | |
|---|---|---|
| FR | 2 865 158 A1 | 7/2005 |
| WO | WO 98/39075 A1 | 9/1998 |

OTHER PUBLICATIONS

European Search Report for EP 10 38 0158 dated May 30, 2011.

* cited by examiner

*Primary Examiner* — Dana Ross
*Assistant Examiner* — Kyle Grabowski
(74) *Attorney, Agent, or Firm* — Cook Alex Ltd.

(57) ABSTRACT

The book consists, in a conventional way, of a series of pages, each one of them being formed by two plates of hard cardboard and an intermediate layer made of rubber foam. The cardboard plate (1) of the front side and the cardboard plate (1') of the reverse side respectively incorporate slots (3, 3'), that describe a trajectory with the shape of an "L", or any other appropriate trajectory. The slots (3, 3') are intended to allow the children to introduce their fingers and move a cursor (4) that slips through a slot (5) in the rubber foam layer (2), thus making an itinerary or path for the cursor (4), that can be followed with the finger of the child through the path created by such slot (5) of the rubber foam layer (2).

1 Claim, 3 Drawing Sheets

CHILDREN'S BOOK

FIELD OF THE INVENTION

The present invention refers to a children's book containing captions, pictures, or any kind of drawings or motifs that are appropriate and pleasant for children.

The object of the invention is to entertain and attract children, so that they become interested in the contemplation of the images or the captions contained in the inner pages of a book

BACKGROUND OF THE INVENTION

There is a children's book, already known in the art, whose structure is based on the fact that each page consists of three plates, two outer ones that are made of strong cardboard and another intermediate plate, which is thicker and made of foam rubber or a similar material and slightly protrudes with respect to the edge of the outer cardboards of each page, to prevent children from cutting themselves with the edge of such cardboard plates while they are using the book.

Furthermore, in this type of book, the cardboard of the reverse side seamlessly continues with the cardboard located at the front side of the next page, and this occurs in all pages, so that the rubber-foam layers are inserted exactly between the cardboards corresponding to the front side and the reverse side of each page.

The main issue to be considered with this type of books is the makeup or structure of the book, but this does not represent any incentive for children.

SUMMARY OF THE INVENTION

The book which is claimed herein corresponds to the kind of books described in the previous section, i.e. a book consisting of one or more pages formed by three layers, two outer ones made of a resistant cardboard and an intermediate layer made of rubber foam, where this latter one protrudes from the other two layers, to prevent children from cutting themselves with the edges of the sheets, and has the peculiarity that the cardboards include a slot following an adequate path, this slot facing another one made to that effect in the relevant rubber foam layer. This latter one, i.e., the slot made on the rubber foam layer, is broader, to allow the slippage of a cursor which is blocked without departing from the trajectory determined by the slots made on the cardboard and the rubber foam layers, as a result of the lesser size of the slot corresponding to each one of the cardboards of the pages. This way the slots made on the cardboard plates allow the child to introduce its finger to turn the pages, with the peculiarity that the slippage of the cursor through the slots made on the different pages allows one to ascertain at any time the exact point of the motif, drawing or caption where the reader has come, apart from being a means that provides a great interest and attraction for children, who can slip the cursor through the slots to glance through the book. Therefore, if the book, for instance, represents a walk through a forest, that appears represented on the pages, as the child sees the images or reads the texts, it can move the cursor which, on the one hand, makes the book more attractive, and on the other hand, serves as a bookmark to ascertain at any time the exact point of the book where the reader is.

Obviously, the slippage of the cursor from one page to another requires that the book is open 180°, since, when the book is closed, the cursor may only slip through the slot of the cover page.

DESCRIPTION OF THE DRAWINGS

In order to complement the following description, and for a better comprehension of the features of the invention, a preferred exemplary embodiment of such invention is represented in the attached set of drawings, where, for illustration, and without limitation, the following has been represented.

DETAILED DESCRIPTION OF THE PREFERRED EMBODIMENT

Figure 1:
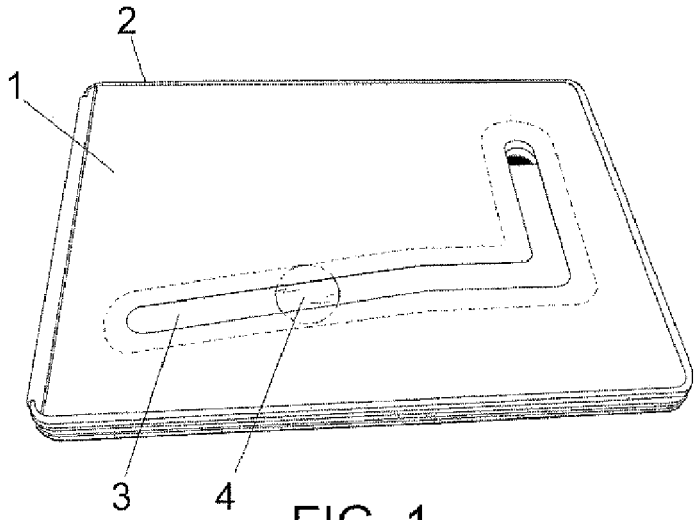
FIG. 1—Shows a perspective view of the book of the invention in its closed position, showing the slot of the cover page and the cursor located at an intermediate point of such slot.
Figure 2:
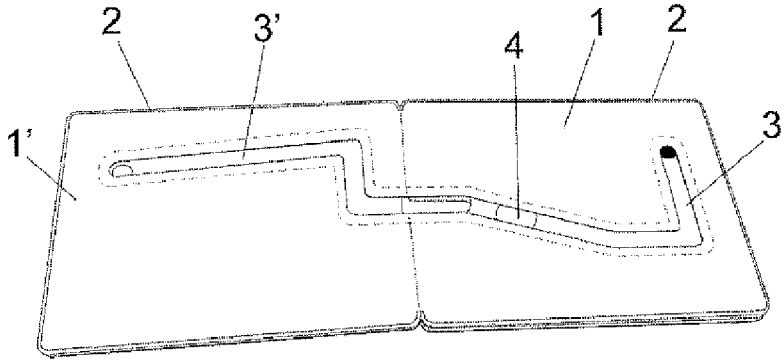
FIG. 2—Shows a perspective view of the book represented in the previous figure, with the book opened 180°, showing the trajectory marked by the slots of both pages with the cursor at an intermediate area.
Figure 3:
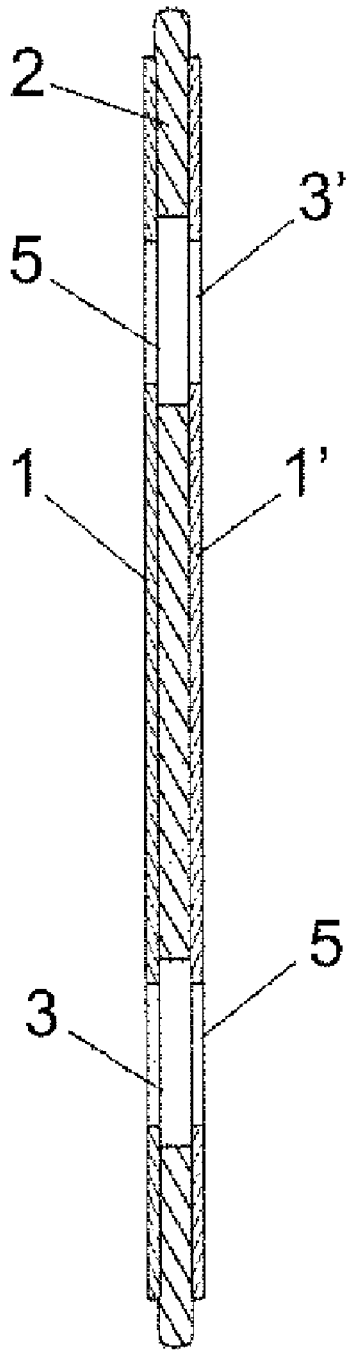
FIG. 3—Shows a cross-section of one of the pages of the book depicted in the previous figures, showing the slot of each one of the outer cardboard plates of the page, and the broader slots corresponding to the previously mentioned slots.
Figure 4:
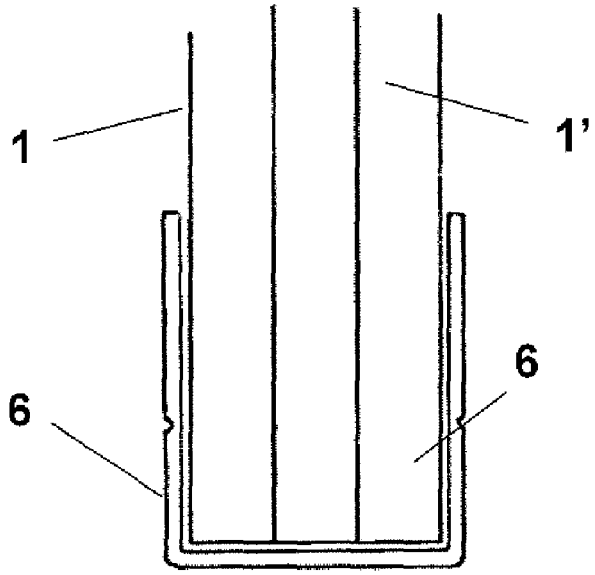
FIG. 4—Shows a side view of the book spine in a closed position.
Figure 5:
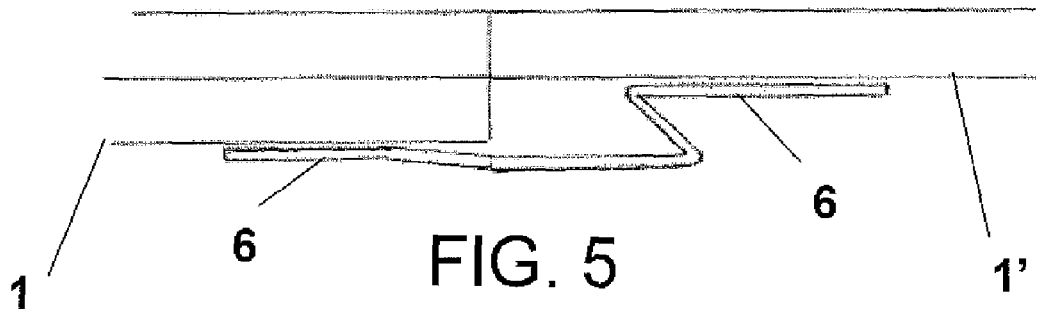
FIG. 5—Shows a side view of the book spine in an open position, where the opening of 180° between the pages can be appreciated.

As it can be appreciated in the above mentioned drawings, the book that is the subject matter of the invention consists, in a conventional way, of a series of pages, each one of them being formed by two plates of hard cardboard, (1, 1'), and an intermediate layer (2) preferably made of rubber foam or a similar material, with the peculiarity that the intermediate layer slightly protrudes from the perimeter edge of the cardboard plates (1, 1') as it has been represented in FIGS. 1-3.

According to the figures, the front side of each page will correspond to the cardboard plate (1), and the reverse side will correspond to the cardboard plate (1'). In every case, the perimeter (1, 1') of each page is slightly smaller than the perimeter of the rubber foam layer (2) of the same page, as it has been previously indicated and represented in the figures. This allows to open the book 180° and to obtain, when the book is completely opened, a totally flat surface between the pages.

The hard cardboard plate (1) of the front cover and the hard cardboard plate (1') of the back cover are joined by means of a cloth cardboard that serves as the book spine.

In view of these characteristics, the invention includes the novelty that both the cardboard plate (1) of the front side and the cardboard plate (1') of the reverse side respectively incorporate slots (3, 3'), that describe a trajectory with the shape of an "L", as it has been represented in the figures, or any other appropriate trajectory. The slots (3, 3') are intended to allow the children to introduce their fingers and move a cursor (4) that slips through a slot (5) seen at the rubber foam layer (2), thus making an itinerary or path for the cursor (4), that can be slipped with the finger of the child through the path created by such slot (5) of the rubber foam layer (2), preventing it from coming off thanks to the narrower width of the slots (3, 3') of the cardboard plates (1, 1').

Therefore, the cursor (4) slips through the path created between the slots (3, 3') and (5), so that if the cursor (4) starts its trajectory at the beginning of the slot (3) corresponding to the cover of the book, when the end of the trajectory of such slot (3) of the cover is reached, the end of such slot (3) faces the initial end of the slot (3') corresponding to the cardboard plate of the reverse side of such page. Then when the page is turned as if it were the page of a conventional book, the user finds that the cursor (4) is accessible to slip it through the inner slot (3') and, provided that the book is open at an angle of 180°, to pass the cursor, as represented in FIG. 2, through the slot (3) of the front side of the following page, and so on. Because the trajectory followed by each page is different, once the edge of each page has been reached, the displacement can continue at the following page, until the book has been finished. Therefore, the above described slots set a path that runs from the cardboard plate of the cover of the book to the cardboard plate of the last page. The cursor (4) may slip through the slots opened whenever a page is turned, so that the cursor (4) will face at any time the caption, motif or drawing belonging to the relevant page. Thus, the book is appealing for children and allows them to know, at any time, the exact point of the book they are reading, on the basis of the position of the cursor (4), which acts as a bookmark.

The invention claimed is:

1. A children's book, comprising one or more pages where each page is structured around three plates, consisting of two outer plates (1 and 1') made of a strong cardboard-like material and an intermediate layer (2) consisting of rubber foam-like material, the intermediate layer (2) protruding in every page (1 and 1') beyond a perimeter edge formed by the cardboard plates, characterized in that it the book can be opened 180°, providing a completely flat surface between the pages and in that the outer plates (1 and 1') corresponding to the front side and the reverse side incorporate slots (3 and 3') with a variable path and broad enough to allow to introduce one finger through the slot, while the intermediate layer (2) incorporates slots (5) located in front of the slots (3 and 3') of the outer plates, to allow movement of a cursor (4) along the slots, while retaining the cursor in a path defined by the slots, the slots (3 and 3') in the outer plates (1 and 1') being narrower than the slot (5) in the intermediate layer (2); the path followed by the slots (3) corresponding to the front side of each page being different from the path followed by the slots (3') of the reverse side of such page, and the end of the slot (3) of the front side of each page coinciding with the start of the slot (3') of the reverse side of such page; such slots (3 and 3'), the slots (5) setting a path running from the book cover to the end of the book, where the cursor (4) can be slipped, said cursor being placed, at any given time, on coincidence with a figure, caption or motif illustrated in the pages of the book.

* * * * *